US006363551B1

(12) United States Patent
Flores

(10) Patent No.: US 6,363,551 B1
(45) Date of Patent: Apr. 2, 2002

(54) AIR-FLOW CONTAINMENT AND DISTRIBUTION ASSEMBLY

(76) Inventor: Mark A. Flores, 1020 Donlon Ave., Oxnard, CA (US) 93030

( * ) Notice: Subject to any disclaimer, the term of this patent is extended or adjusted under 35 U.S.C. 154(b) by 0 days.

(21) Appl. No.: 09/460,108

(22) Filed: Dec. 13, 1999

(51) Int. Cl.[7] ..... A47C 21/04

(52) U.S. Cl. ..... 5/423; 5/941; 5/421

(58) Field of Search ..... 5/423, 941, 421, 5/726; 607/104, 96, 108, 107, 111, 1; 165/46; 219/211, 528, 212, 512, 549, 369

(56) References Cited

U.S. PATENT DOCUMENTS 2,235,966 A * 3/1941 Summers ..... 5/502
5,165,400 A * 11/1992 Berke ..... 5/482
5,655,237 A * 8/1997 Suzuki et al. ..... 5/502
5,730,120 A * 3/1998 Yonkers ..... 5/423

* cited by examiner

*Primary Examiner*—Lynne H. Browne
*Assistant Examiner*—Fredrick Conley
(74) *Attorney, Agent, or Firm*—Albert O. Cota

(57) ABSTRACT

An air-flow containment and distribution assembly (10) consisting of a bed sheet (24) or an agricultural parcel cover (22), an air duct (38) and an electric fan (14) that preferably includes a speed control (18) and a heating element (20). The cover (22,24) includes at least one air-duct opening (36) located near an edge of the cover (22,24), and the air duct (38) includes a closed front section (48) and an open rear end (50). The duct's front section (48) has a bulbous shape (58) and a rectangular opening (52) dimensioned to be attached to the air-duct opening (36) and the rear end (50) forms a shroud (56) that attaches to the fan (14). When the bed sheet (24) is placed over a bed mattress (100), the air (12) from the fan (14) flows through the air duct (38) and under the sheet (24) to maintain a person or persons under the bed sheet at a selectable air flow and temperature. Likewise, the air flowing under the agricultural parcel cover (22) safeguards the produce from damaging adverse weather.

17 Claims, 5 Drawing Sheets

AIR-FLOW CONTAINMENT AND DISTRIBUTION ASSEMBLY

TECHNICAL FIELD

The invention pertains to the general field of relatively flat, resilient covers used for bed sheets or to cover an agricultural parcel and more particularly, to a cover that includes a means for supplying an air flow under the cover which maintains a person(s) or a produce under the cover at a selectable temperature.

BACKGROUND ART

Every human being must sleep, that is a naturally accepted fact. The quantity and quality of sleep that a person experiences various greatly, though ever since people realized that sleep was inevitable there have been attempts made to improve upon the conditions under which we sleep. One of the most obvious conditions that affects our sleep is the environment. For anyone who has ever slept outdoors it is readily obvious how much sleep is governed by the ambient temperature, living conditions, illumination, etc., In colder regions people sleeping outdoors and indoors have become used to the practice of maintaining some type of heat as well as utilizing multiple layers of covering. People who reside in temperate or even warm regions have discovered what many feel is a more difficult dilemma.

As it gets colder, heat may be increased or coverings added, but, as it gets hotter, there is a limit to how much can be removed. Unless a person resides in a year-round, climate-controlled environment, which can become very expensive to maintain, there have been attempts to solve the problem of sleeping, or even resting during hot weather. The most obvious and widely used solution has been a fan. In addition to providing a degree of cooler air, the actual air flow has been shown to be soothing on a person's skin.

Unfortunately, unless a fan is placed literally inches away from a person, a great amount of air is blown into areas where it is not needed. Once the air exits from the fan's blades it disperses very rapidly. What is needed is a means of controlling and directing air flow over a specific area. In this manner much less air would be needed for its purpose. Additionally, a controlled and contained air flow could be used for a variety of purposes other than sleeping, such as regulating the temperature on agricultural lands, thus protecting crops from damage.

If desired, a fan could be utilized with a heating element that would then allow both heated or cooler air to be dispersed over a specific area.

A search of the prior art did not disclose any patents that read directly on the claims of the instant invention however, the following U.S. patents were considered related:

| U.S. PAT. NO. | INVENTOR | ISSUED |
|---|---|---|
| 5,730,120 | Yonkers | Mar. 24, 1998 |
| 5,683,441 | Dickerhoff, etal | Nov. 4, 1997 |
| 4,660,388 | Greene | Apr. 28, 1987 |

The U.S. Pat. No. 5,730,120 discloses a bed ventilator which includes an electric axial flow fan for moving air between a mattress and a bed cover thereon. The fan and duct work is mounted on a flat support tongue extended beneath the mattress and sandwiched between the mattress and its supporting bed structure such as a box spring. The duct work includes telescopic duct sections adjustable to accommodate mattresses of different thickness. Locking screws are provided for securing a selected telescopic relation between the duct sections for a particular mattress involved.

The U.S. Pat. No. 5,683,441 discloses a blanket for use with forced air convection systems. The blanket includes an airflow deflector internal to the blanket and located near the air inlet port of the blanket. By providing a blanket with an airflow deflector better distribution of air within the confines of the blanket may be achieved, which helps to reduce and eliminate problems associated with hot and cold spots within the blanket.

The U.S. Pat. No. 4,660,388 discloses a cooling cover having an air inflatable paid which is positioned within a pocket of a coverlet. The pad is formed of air impermeable material and has plenum chambers at opposite ends thereof, and a plurality of individual longitudinally extending passages which extend between the plenum chambers. Air orifices of a non-uniform pattern in the lower rounded surfaces of the inflatable paid direct cooling air in a plurality of small air jets onto the body of a user of the cooling cover. A source of cool air is connected to an inlet to deliver cool air to the pad.

For background purposes and as indicative of the art to which the invention relates, reference may be made to the following remaining patents found in the search:

| U.S. PAT. NO. | INVENTOR | ISSUED |
|---|---|---|
| 5,596,778 | Suzuki et al | Jan. 28, 1997 |
| 5,125,238 | Ragan | Jun. 30, 1992 |
| 5,030,495 | Neu | Jul. 9, 1991 |
| 4,939,804 | Grant | Jul. 10, 1990 |
| 3,840,923 | Bos | Oct. 15, 1974 |

DISCLOSURE OF THE INVENTION

In its most basic design, the air-flow containment and distribution assembly is comprised of means for creating a selectable air flow; a cover adapted to be placed over a substantially flat area having a front edge, a rear edge, a right edge and a left edge, at least one air duct opening located proximal to one of the edges of the cover; and means for applying the air flow into the at least one air duct, wherein the air flows into the cover and vents out from at least one of the edges of the cover.

In view of the above disclosure, the primary object of the invention is to provide a means by which a person can apply air over a substantially flat surface, such as a bed or an agricultural parcel.

Another object of the invention is to provide air that may be heated or remain at the ambient temperature, depending on the particular application that is being used.

Still another object of the invention is to provide a more economical means of altering the temperature of a selected area. Instead of dispersing the air everywhere, the air can be directed over a specific location.

Yet another object of the invention is to allow a selectable quantity of air to be dispersed over a specific area.

Another object of the invention is to provide an alternative environment for sleeping, when the invention is used on a bed. Instead of simple sleeping under sheets, with or without a conventional fan blowing, the invention provides a unique environment which allows for better sleeping conditions.

In addition to these objects of the invention, it is also the object of the invention to provide an air-flow containment and distribution assembly that is:

a relief on hot summer nights, can be used in conjunction with aroma therapy, a relief to individuals with sunburned skin or those who have skin irritation, rashes, fevers and night sweats, beneficial for people who sleep during the day, is cost effective from both a consumers and manufacturers point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
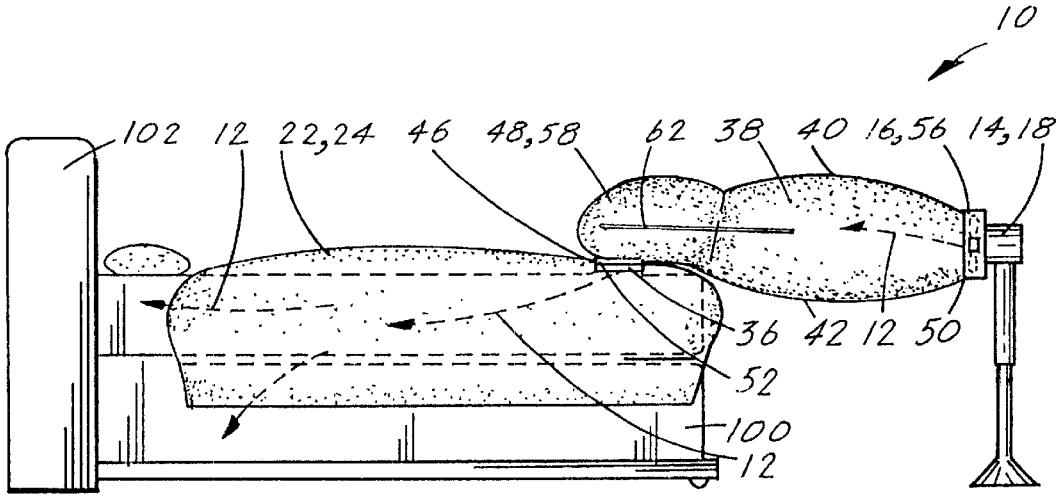
FIG. 1 is a side elevational view of an air-flow containment and distribution assembly configured for use as a bed sheet.

The best mode for carrying out the invention is presented in terms of a preferred embodiment for an air-flow containment and distribution assembly. In addition to the preferred embodiment there can be multiple design configurations of the invention for a variety of applications. The air-flow containment and distribution assembly 10, hereinafter "assembly 10", is shown in FIGS. 1–11 and is comprised of the following major elements: air flow 12; air flow means, such as an electric fan 14; a cover 22; an air duct opening 36; and air duct(s) 38 and 76. For descriptive and illustrative purposes a bed which includes a headboard 102 having a mattress 100, and an agricultural parcel 104 are also shown in the figures.

Figure 2:
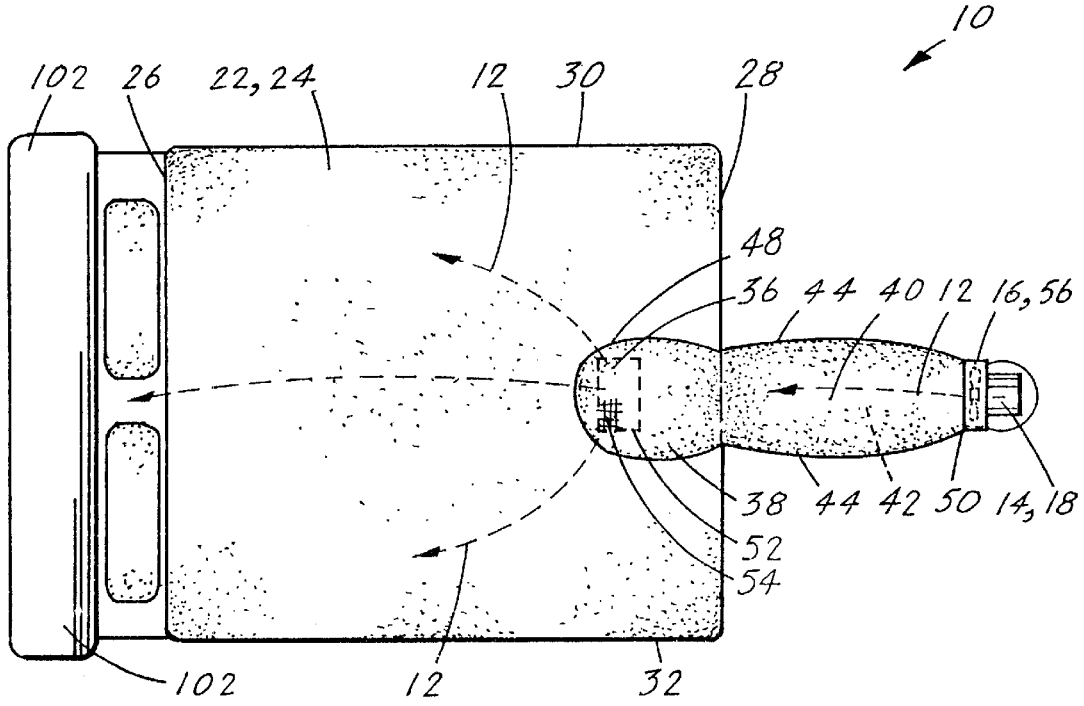
FIG. 2 is an upper plan view of the air-flow containment and distribution assembly configured for use as a bed sheet.

As shown in FIGS. 1 and 2 one of the applications that the assembly 10 is used for is to provide air flow 12 over a bed 100. In order to produce the air flow 12 the electric fan 14 is utilized. The fan 14, as shown in FIGS. 1 and 2, has an outer circumference 16, a fan speed control 18 which selectively controls the force of the air flow 12, and may further comprise a heating element 20 that produces a heated air flow 12. Whenever the assembly 10 is used on a bed 100, the cover 22 is comprised of a bed sheet 24, having a front edge 26, a rear edge 28, a right edge 30, and a left edge 32. As shown in FIG. 1, the bed sheet 24 is dimensioned to allow the rear edge 28 to be tucked under the bed mattress 100, and the right and left edges 30,32 to drape over the sides of the bed mattress 100.

The bed sheet 24 is made in two sizes. The first size has a length of 108-inches (27.4 mm) and a width of 90-inches (22.9 mm) and is sized to fit twins size mattresses, daybeds, couches and recliners. The second size has a length of 104-inches (26.4 mm) and a width of 110-inches (27.9 mm) and is sized to also fit twin size mattresses, and full, queen, California Queen and Eastern King mattresses. In addition to the above bed sheets 24 a "one size fits all" bottom bed sheet (not shown) can be included to form a matching set of sheets.

In order to permit the air flow 12 to enter the area of the bed mattress 100, the air duct opening 36 is utilized. As shown in FIG. 2, the air duct opening 36 is substantially laterally centered and is comprised of a single air duct opening 38 having a rectangular shape and located proximal to the rear edge 28 of the bed sheet 24. The means for applying the air flow 12 from the electric fan 14 into the air duct opening 36 is comprised of the air duct 38, as shown in FIGS. 1, 2 and 3.

The air duct 38 is preferably constructed from a cloth or similar material and consists of an upper panel 40, a lower panel 42, and two side panels 44. When the panels 44 are attached by an attachment means 46 such as stitching, the air duct 38 has a closed front section 48, an open rear end 50, and proximal to an edge of the closed front section 48 and the lower panel 42, a rectangular opening 52. As shown in FIG. 2, the rectangular opening 52 is dimensioned to be attached over the single air duct opening 36 that is located on the bed sheet 24. Once attached, the open rear end 50 forms a shroud 56 that is attached by an attachment means around the circumference 16 of the fan 14.

Figure 3:
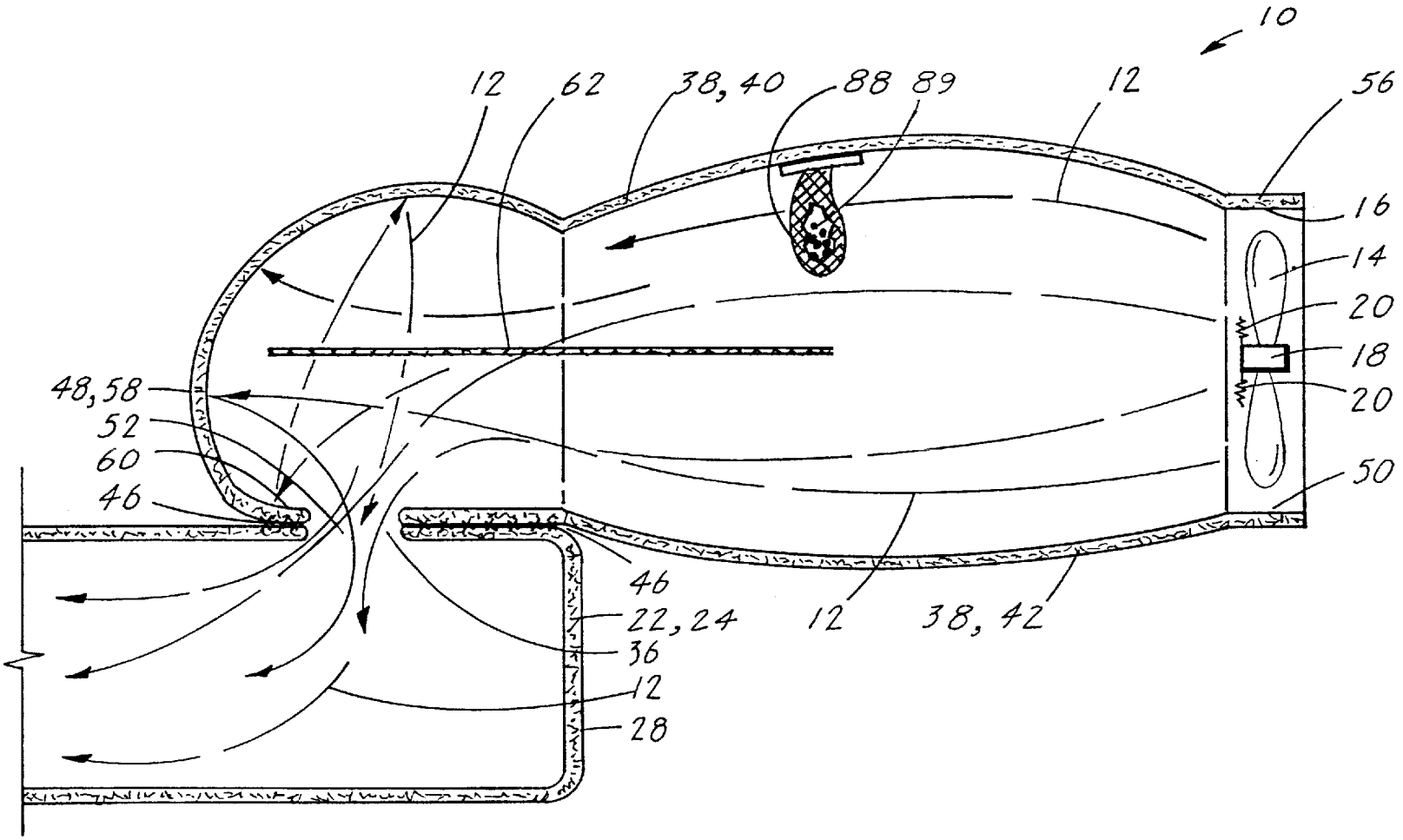
FIG. 3 is a side sectional view of an air duct attached to an edge of a bed sheet and illustrating a typical air flow pattern produced by a fan attached to the rear end of the air duct.

As shown in FIGS. 1, 2 and 3 when air is flowing through the air duct 38, the air impinges on the closed front section 48 and thus forms a bulbous section 58 which has a curvature that aids in directing the air flow 12 into the rectangular opening 52 and the air duct opening 38 on the bed sheet 24. Further, when the rectangular opening 52 on the air duct 38 is attached to the air duct opening 36, an inner extending tab 60 is formed, as shown in FIG. 3. When the air flow impinges on the tab 60, the air is reflected in a direction which aids in maintaining the curvature of the bulbous section 58.

Additionally, the output of the air duct 38 can be designed to include a filter 54 as shown in FIG. 2. The filter is designed to reduce the count of air-held particulate matter that enters the bed sheet 24 and that could adversely affect the health of some persons that are under the bed sheet 24.

Figure 4:
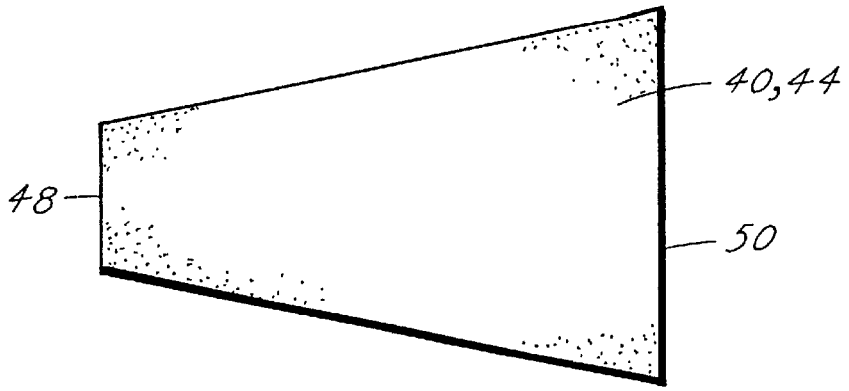
FIG. 4 is a plan view of an air duct upper panel and side panels.
Figure 5:
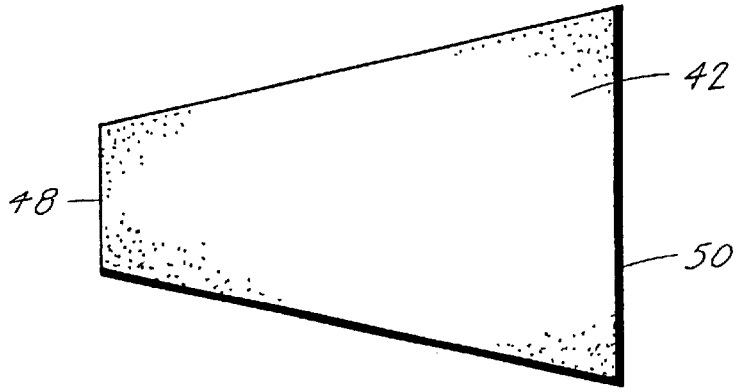
FIG. 5 is a plan view of an air duct lower panel.

As shown in FIGS. 4 and 5, the upper panel 40 and the two side panels 44 of the air duct 38 each have a 10-inch (25.4 cm) front end, a 22-inch (55.9 cm) rear end, and a length of 48-inches (121.9 cm). The lower panel 42 has a 10-inch (25.4 cm) front end, a 22-inch (55.9 cm) rear end, an a length of 43-inches (109.2 cm). As shown in FIG. 3, along each of the two air duct side panels 44 is located at least one pleat 62. The pleat(s) 62 is longitudinally formed and aids to maintain the curvature of the bulbous section 58 when air is flowing.

Figure 6:
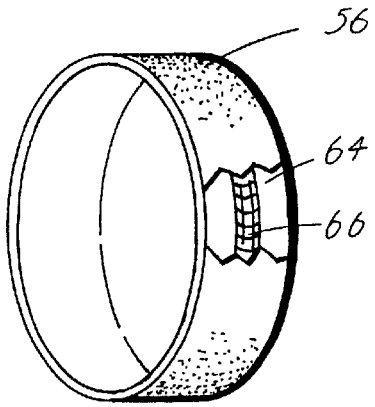
FIG. 6 is a perspective-fragmented view of an air duct shroud that attaches to the fan. The figure also illustrates a shroud having a circumferential sleeve into which is inserted an elastic band.
Figure 7:
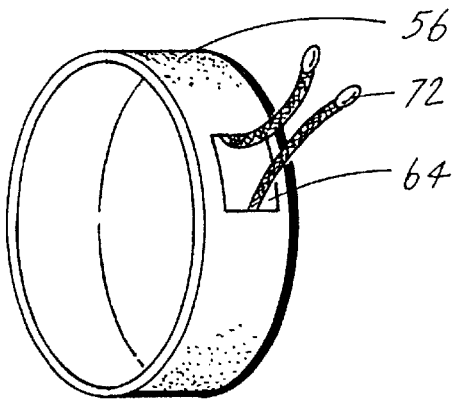
FIG. 7 is a perspective-fragmented view of an air duct shroud that attaches to the fan. The figure also illustrates a shroud having a circumferential sleeve which houses a pair of tie lines that project through an opening in the sleeve.

As shown in FIG. 6 the means for attaching the shroud 56 of the air duct 38 around the circumference 16 of the fan 14 comprises the shroud 56 having a circumferential sleeve 64, into which is inserted a continuous elastic band 66 that cinches around the fan's circumference 16. Another means by which the shroud 56 may be attached to the fan 14 is comprised of the shroud 56 having a circumferential sleeve with an opening 70. As shown in FIG. 7, a tie line 72 is inserted into the sleeve with the tie line ends extending outward from the opening 70. When the ends of the tie line 72 are pulled, the shroud 56 cinches around the circumference 16 of the fan 14, at which time the two tie line ends are tied together to hold the shroud 56 against the fan 14.

Figure 8:
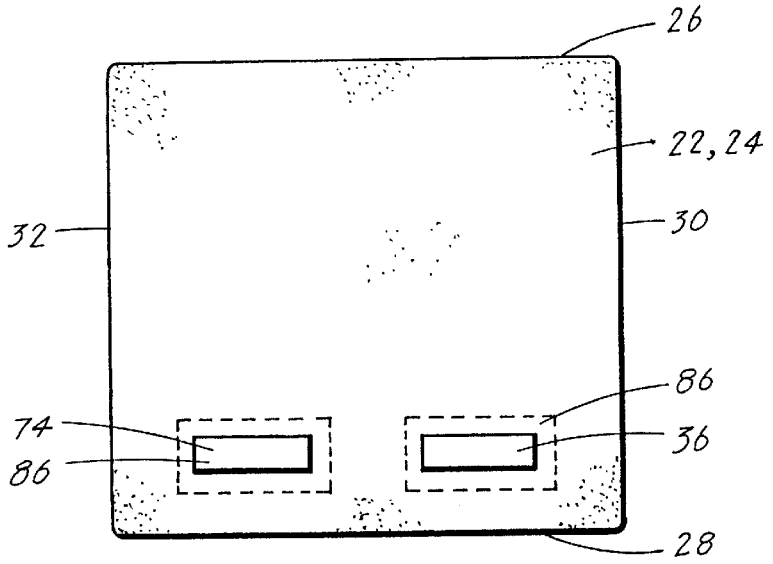
FIG. 8 is an upper plan view of a cover configured as a bed sheet and having a pair of air duct openings.
Figure 9:
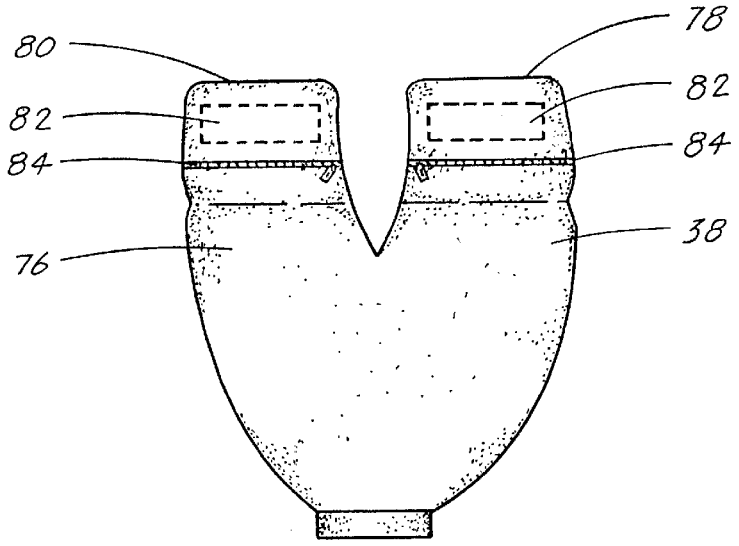
FIG. 9 is an upper plan view of an air duct having a pair of air ducts each having a closure means which allows the air flow to be selectively turned on or off.

As shown in FIG. 8, there may be multiple air duct openings. The first air duct opening 36, as previously described, has a rectangular shape; a second air duct opening 74 also has a rectangular shape. Both openings 36,74 are located proximal to the rear edge 28 of the cover 22 and are laterally spaced. When two air duct openings 36,74 are utilized, there must be two corresponding air ducts. The air duct 38 has been previously described, another air duct 76 design is also made from a cloth or similar material, but instead of having only a single duct, the air duct 76 has a front portion that branches out into two air ducts 78 and 80, as shown in FIG. 9. As with the first air duct 38 design, each air duct 78,80 of the second air duct 76 has a closed front sections, and is proximal to an edge of the closed front sections and on a lower surface is located a rectangular opening 82. Each rectangular opening is dimensioned to be respectively attached by an attachment means, such as stitching, over the first and second air duct openings 36,74. The second air duct also has an open rear end that forms a shroud, which is attached around the circumference 16 of the fan 14. To further the utility of the second air duct design, each air duct 78,80 may further comprise a closure means 84, which allows the air flow to selectively turned on or off, as shown in FIG. 9.

Additionally, a porous material 86 may be attached under each air duct opening 36,74 as shown in FIG. 8, thus causing the sheet 24 to maintain the structural integrity of the duct opening 36 or 74.

If desired, a porous pouch 88 having an upper edge attached to an interior surface of the air duct 38, as shown in FIG. 3. Within the pouch 88 is located a solid form of fragrance 89, and when air flows through the air duct, the air passes through the porous pouch 88, thus causing the fragrance 89 to spread through the interior of the sheet 24.

Figure 10:
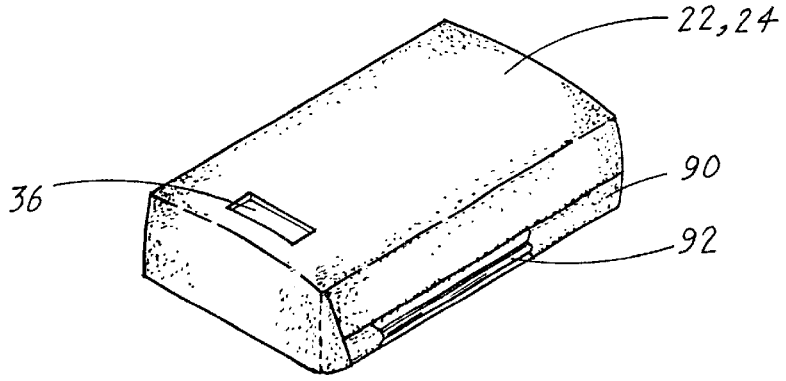
FIG. 10 is a perspective view of a bed sheet cover wherein the right and left edges have a sleeve into which is inserted a rod which maintains the bed sheet in a stationary position.

As shown in FIG. 10, the right and left edges 30,32 of the sheet 24 further comprises a sleeve 90 into which is slidably inserted a rod 92, which adds sufficient weight to maintain the sheet 24 in a stationary position. Additionally, the rectangular opening 52 on the air duct 38 is attached to the air duct opening 36 by a removable means, which allows the air duct 38 to be removed from the sheet 24 when washing the sheet 24 or air duct 38.

Figure 11:
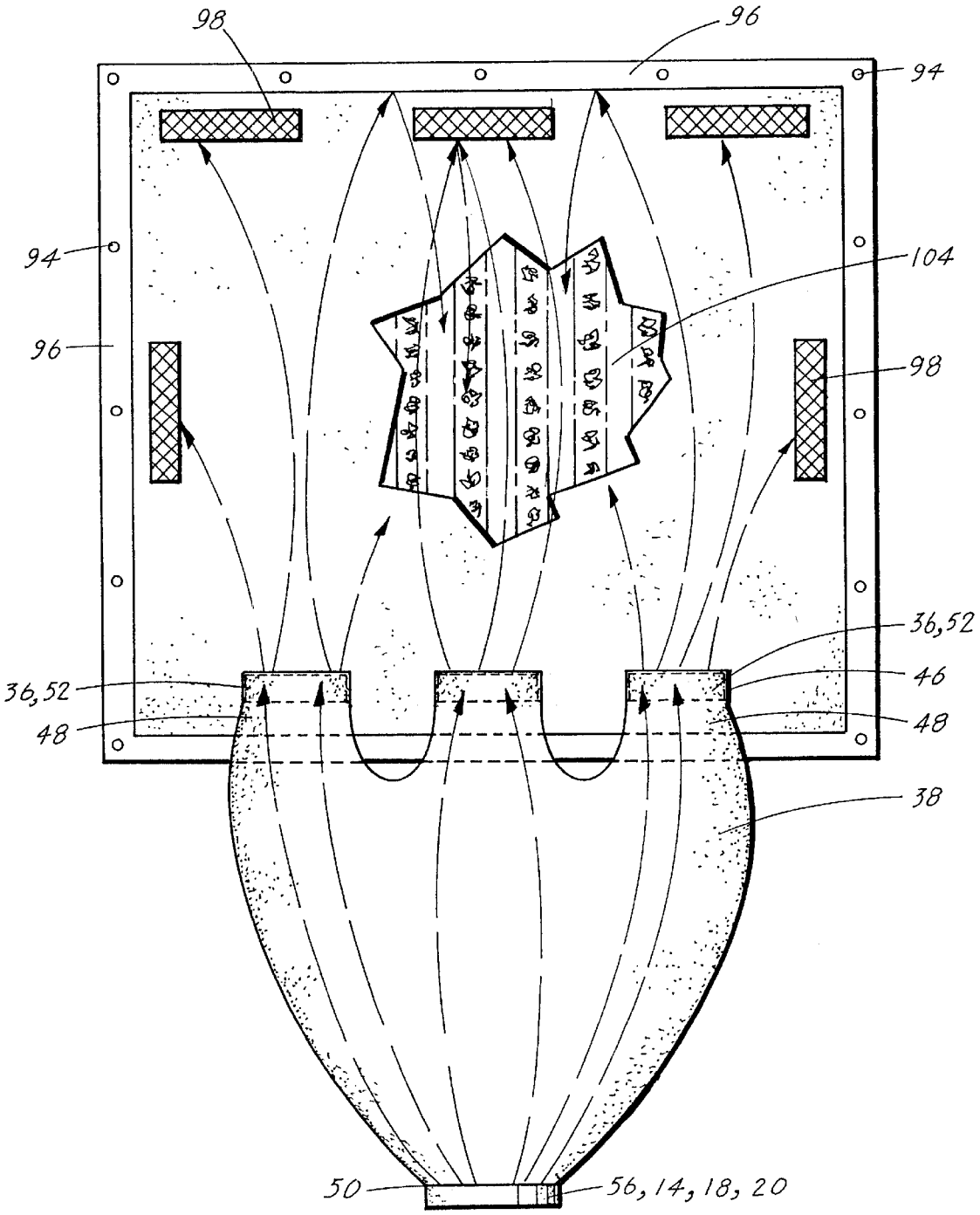
FIG. 11 is an upper plan view of a cover dimensioned to be placed over an agricultural parcel of land, wherein to an edge of the cover is located a plurality of air duct openings to which are attached a plurality of air ducts.

A second application of the assembly 10 is shown in FIG. 11, and is dimensioned to cover various sizes of a cultivated, agricultural parcel 104. The cover 22 is comprised of an agricultural parcel cover 96 and is selectively cut to completely cover the parcel 104. The cover 96 is anchored around the perimeter of the parcel by an anchoring means 94 such as stakes that can be adjusted for height to compensate for the height of the produce being grown, weights, an inflatable structure or a combination of the three.

The cover 96 which is made of a flexible material includes a plurality of air duct openings 36 and a plurality of air-flow vents 98. The air-duct openings 36 are each located proximal to one of the cover edges as shown in FIG. 11. The number of openings is dependent upon the size of the parcel 104 and in some cases the produce that is being grown. The air-flow vents 98 are located near the edges of the cover 22 and the number of vents 98 is again dependent upon the size of the parcel.

The air flow is supplied by an electric fan 14 that may include a heating element if warm air is beneficial to maintain the growth of the produce being grown. Between the fan 14 and the plurality of air duct openings 36 is an air duct 38. The air duct 38 which is also constructed from a flexible material includes a front portion and an open rear end 50. The open rear end is attached around the circumference of the fan by an attachment means as described supra. The front portion is designed with a plurality of rectangular openings 52 dimensioned to be attached to the corresponding air-duct openings 36 on the cover 22 by an attachment means. Between the air duct openings 36 is a gathered stitched area that forms a lateral baffle which aids in directing and spreading the air flow sequentially through the rectangular openings 52, the air-duct openings 36 into the agricultural parcel 104 and out the air-flow vents 98. In cold or freezing temperatures, the application of an air flow and in particular a heated air flow having a higher temperature than the ambient outside temperature helps to assure that the crops will not be injured by adverse weather.

While the invention has been described in complete detail and pictorially shown in the accompanying drawings it is not to be limited to such details, since many changes and modifications may be made to the invention without departing from the spirit and the scope thereof. For example, the design of the assembly 10 can be enhanced by including a bug exclusion net (not shown) having an inner edge, an outer edge and sides that extend downward from the sides of the bed mattress 100. The inner edge includes a means, such as a strip of a hook and loop fasteners, which allows the inner edge to be attached to the front edge 26 of the bed sheet 24. Likewise, the outer edge includes a means for being attached to an upper structure such as a bed headboard 102. Hence, the invention is described to cover any and all modifications and forms which may come within the language and scope of the claims.

What is claimed is:

1. An air-flow containment and distribution assembly comprising:

a) an electric fan having an outer circumference and a fan speed control which selectively controls the air flow, wherein said electric fan further comprises a heating element that produces a heated air flow, b) a cover adapted to be placed over a substantially flat area having a front edge, a rear edge, a right edge and a left edge, c) at least one air duct opening located proximal to one of the edges of said cover, wherein said at least one air duct opening is substantially laterally centered and is comprised of a single air duct opening having a rectangular shape and located proximal to the rear edge of said bed sheet; and d) means for applying the air flow into said at least one air duct opening, wherein the air flows into said cover and vents out from at least one of the edges of said cover, wherein said means for applying the air flow from said fan into the single air duct opening comprises an air duct made from a cloth and consisting of an upper panel, a lower panel and two side panels, wherein when said panels are attached, by an attachment means, said air duct has a closed front section, an open rear end, and proximal to an edge of the closed front section and the lower panel is located a rectangular opening that is dimensioned to be attached, by an attachment means, over the single air duct opening on said bed sheet, wherein the open rear end forms a shroud that is attached, by an attachment means, around the circumference of said fan, wherein when air is flowing through said air duct the air impinges on the closed front section of said air duct to form a bulbous section having a curvature which aids in directing the air flow into the rectangular opening and the air duct opening on said bed sheet, wherein when the rectangular shape opening on said air duct is attached to the air duct opening on said bed sheet an inner extending tab is formed, wherein when the air flow impinges on the tab, the air is reflected in a direction which aids to maintain the curvature of the bulbous section.

2. The air-flow containment and distribution assembly as specified in claim 1 wherein said flat area comprises a bed which includes a mattress.

3. The air-flow containment and distribution assembly as specified in claim 2 wherein said cover comprises a bed sheet that is dimensioned to allow the rear edge to be tucked under the mattress and the right and left edges of said bed sheet to drape over the sides of the bed mattress.

4. The air-flow containment and distribution assembly as specified in claim 1 wherein the upper panel and the two side panels each have a 10-inch (25.4 cm) front end, a 22-inch (55.9 cm) rear end and a length of 48-inches (121.9 cm), and wherein the lower panel has a 10-inch (25.4 cm) front end, a 22-inch (55.9 cm) rear end and a length of 43-inches (109.2 cm), wherein the sides of all the panels are attached by stitching.

5. The air-flow containment and distribution assembly as specified in claim 4 further comprising at least one pleat longitudinally formed along each of the two side panels, wherein said at least one pleat aids to maintain the curvature of the bulbous section when air is flowing.

6. The air-flow containment and distribution assembly as specified in claim 1 wherein said means for attaching the shroud of said air duct around the circumference of said fan comprises said shroud having a circumferential sleeve into which is inserted a continuous elastic band that cinches around the circumference of said fan.

7. The air-flow containment and distribution assembly as specified in claim 1 wherein said means for attaching the shroud of said air duct around the circumference of said fan comprises:

a) said shroud having a circumferential sleeve having an opening, and b) a tie line inserted into said sleeve with the tie line having two ends extending outward from the opening on said shroud sleeve, wherein when the two ends are pulled, said shroud cinches around the circumference of said fan, at which time the two ends are tied together to hold the shroud against the fan circumference.

8. The air-flow containment and distribution assembly as specified in claim 1 wherein said means for applying the air flow from said fan into the two air duct openings comprises an air duct made from a cloth and having a front portion that is split into a first air duct and a second air duct, wherein each said air duct has a closed front section, a single open rear end, and proximal to an edge of the first and second closed sections and on a lower surface is located a rectangular opening, wherein each rectangular opening is dimensioned to be respectively attached, by an attachment means, over the first and second air duct opening on said bed sheet, wherein the open rear end forms a shroud that is attached by an attachment means around the circumference of said fan.

9. The air-flow containment and distribution assembly as specified in claim 8 wherein said first air duct and said second air duct each further comprise a closure means which allows the air flow to be selectively turned on or turned off.

10. The air-flow containment and distribution assembly as specified in claim 1 further comprising a porous pouch having an upper edge attached, by an attachment means, to an interior surface of said air duct, wherein into said pouch is inserted a solid form of a fragrance, wherein when air is flowing through said air duct the air passes through said porous pouch causing the fragrance to spread through the interior of said bed sheet.

11. The air-flow containment and distribution assembly as specified in claim 1 wherein said area comprises an agricultural parcel.

12. The air-flow containment and distribution assembly as specified in claim 1 wherein said cover is dimensioned to cover the agricultural parcel and to be anchored, by an anchoring means, around said agricultural parcel.

13. The air-flow containment and distribution assembly as specified in claim 12 wherein said at least one air duct opening is comprised of a plurality of air duct openings wherein each said opening is located proximal to one of the edges of said cover and spaced laterally.

14. The air-flow containment and distribution assembly as specified in claim 13 wherein said means for applying the air flow from said fan into the plurality of air duct openings comprises an air duct constructed from a flexible material having a front portion and an open rear end, wherein the open rear end forms a shroud that is attached, by an attachment means, around the circumference of said fan and wherein the front portion is designed to be attached to the plurality of said air duct openings and to direct and spread the air flow from said fan over the agricultural parcel, wherein said air flow maintains the agricultural parcel at a constant controlled temperature.

15. An air-flow containment and distribution assembly comprising:

a) an electric fan which produces an air flow, said fan having a fan speed control which selectively controls the air flow, b) a sheet adapted to be placed over a bed, said bed sheet having a front edge, a rear edge, a right edge and a left edge, c) said sheet having an air-duct opening laterally centered and located proximal to the rear edge of said bed sheet, and d) an air duct having a front section and an open rear end, and proximal to a lower edge of the front section is located a rectangular opening that is dimensioned to be stitched over the air duct opening on said bed sheet, wherein the open rear end forms a shroud that is attached, by an attachment means, over said electric fan, wherein the air flows sequentially through the rectangular opening on said air duct, the air duct opening on said bed sheet, said bed sheet and vents out the front edge and the right and left edges of the bed sheet, wherein the air flow maintains a person or persons under said bed sheet at a selectable air flow and temperature, wherein when the rectangular opening on said air duct is attached to the air duct opening on said bed sheet an inner extending tab is formed, wherein when the air flow impinges on the tab, the air is reflected in a direction which aids to maintain the curvature of the shroud.

16. The air-flow containment and distribution assembly as specified in claim 15 wherein the right and left edges of said sheet further comprise a sleeve into which is slidably inserted a rod which adds sufficient weight to maintain said bed sheet in a stationary position.

17. The air-flow containment and distribution assembly as specified in claim 15 wherein the rectangular opening on said air duct is attached to the air duct opening on said bed sheet by a removable means which allows said air duct to be removed from said bed sheet when washing said bed sheet or said air duct.

* * * * *